US006116159A

United States Patent [19]

Koyama

[11] Patent Number: 6,116,159

[45] Date of Patent: Sep. 12, 2000

[54] PAPER WRINKLE PREVENTING DEVICE

[75] Inventor: Hiroshi Koyama, Yokohama, Japan

[73] Assignee: Kabushiki Kaisha Tokyo Kikai Seisakusho, Tokyo, Japan

[21] Appl. No.: 09/289,668

[22] Filed: Apr. 12, 1999

[30] Foreign Application Priority Data

Jul. 23, 1998 [JP] Japan ..... 10-208444

[51] Int. Cl.[7] ..... B41F 13/54

[52] U.S. Cl. ..... 101/228; 226/190; 101/375

[58] Field of Search ..... 101/228, 375, 101/216, 217, 219–220, 181–182; 226/190, 191, 192

[56] References Cited

U.S. PATENT DOCUMENTS

| | | | |
|---|---|---|---|
| 2,206,186 | 7/1940 | Hantjopoulos | 101/228 |
| 2,593,149 | 4/1952 | Illner | 101/23 |
| 2,840,372 | 6/1958 | Alhand | 901/228 |
| 3,691,949 | 9/1972 | Giori et al. | 101/216 |
| 4,119,032 | 10/1978 | Hollis | 101/375 |
| 5,269,222 | 12/1993 | Johnson et al. | 101/228 |
| 5,388,513 | 2/1995 | Ohta | 101/228 |
| 5,507,226 | 4/1996 | Burke et al. | 101/228 |
| 5,511,473 | 4/1996 | Ohmi et al. | 101/228 |
| 5,611,275 | 3/1997 | Iijima et al. | 101/181 |

FOREIGN PATENT DOCUMENTS

| | | |
|---|---|---|
| 62-32204 | 8/1987 | Japan . |
| 6-297605 | 10/1994 | Japan . |

*Primary Examiner*—Eugene Eickholt
*Attorney, Agent, or Firm*—Foley & Lardner

[57] ABSTRACT

Angular deformation is caused in a portion of offset-printed web paper corresponding to an adjacent portion of each of side edges of two blankets of a blanket cylinder so that paper wrinkles are caused. To prevent the paper wrinkles from being caused, a contact roller 10 is arranged in a paper wrinkle preventing device such that a circumferential face of the contact roller can rotatably come in contact with the running web paper W in a rotary printing press having an offset printing portion P for printing the web paper W coming in contact with surfaces of two blankets B2 having side edges adjacent to each other at an approximately axial center of a blanket cylinder B. The contact roller 10 is arranged between the offset printing portion P and a drag roller D1. An equal diameter portion 101*c* is formed by a roller portion coming in contact with an area of the running web paper W coming in contact with an adjacent portion B1 of each of the two blankets B2 and a portion near this adjacent portion. A taper portion 101*t* is formed in each of both side portions of the equal diameter portion 101*c* and has a diameter reduced as each of both the side portions of the equal diameter portion 101*c* approaches an end portion 101*e* of the contact roller.

7 Claims, 5 Drawing Sheets

PAPER WRINKLE PREVENTING DEVICE

BACKGROUND OF THE INVENTION

1. Field of the Invention

This invention relates to a paper wrinkle preventing device of a rotary press, e.g., an offset rotary press for a newspaper having an offset printing portion in which two blankets are arranged so as to set their side edges to be adjacent to each other approximately at the center of a blanket cylinder in its axial direction and a printing operation can be simultaneously performed through these two blankets on web paper running in contact with these two blankets. More particularly, this invention relates to a paper wrinkle preventing device for dissolving angular deformation caused in the web paper approximately along a central position of the blanket cylinder on a downstream side of the offset printing portion, and preventing this angular deformation being wrinkled.

2. Description of the Background Art

It is known in offset printing that wet water reaches web paper through a lithographic plate and a blanket and the web paper is enlarged in width and longitudinal directions. Further, two blankets are arranged such that side edges of the blankets are adjacent to each other approximately at a center of the blanket cylinder in its axial direction. In the offset printing portion, the printing operation can be simultaneously performed through these two blankets on the web paper running in contact with these two blankets. In the offset printing portion, the lithographic plate corresponding to each of the blankets is mounted to a plate cylinder in a state in which side edges of the lithographic plate are slightly separated from each other. The printing operation is performed except for adjacent portions of the side edges of the two blankets.

Therefore, no wet water reaches portions of the web paper corresponding to the adjacent portions of the side edges of the two blankets during the printing operation through the lithographic plate and the blankets so that enlarging amounts of the web paper in these portions are small in comparison with the other paper portions. When the web paper printed by such an offset printing portion is pulled by a drag roller downstream from the offset printing portion, tension of each of the paper portions corresponding to the adjacent portions of the side edges of the two blankets in a running direction becomes larger than that of the other portions in the running direction since the enlarging amount of the web paper caused by the wet water is small. Accordingly, there is a case in which angular deformation is caused in this paper portion between the blanket cylinder and the drag roller downstream from this blanket cylinder.

In particular, the difference in enlarging amount provided by the wet water between the paper portions corresponding to the adjacent portions of the side edges of the above two blankets and the other paper portions is increased in the web paper sequentially continuously printed in plural offset printing portions. When this web paper is pulled by the drag roller downstream from a most downstream offset printing portion, it is confirmed that very clear narrow angular deformation is caused in the paper portions corresponding to the adjacent portions of the side edges of the two blankets between the blanket cylinder of the most downstream offset printing portion and the drag roller downstream from this blanket cylinder.

On the other hand, for example, a technique (prior art 1) described on pages 96 to 97 of "Newspaper Printing Handbook" (published by Japan Newspaper Association Corp. on Apr. 10, 1997) is known as the paper wrinkle preventing device. Namely, in this paper wrinkle preventing device, a reverse crown roller narrowed in a hand drum shape in a central portion of the roller and a crown roller thickened in a drum shape in a central portion of the roller are arranged in positions in which there is a fear that paper wrinkles are caused during a running path of the web paper. The reverse crown roller and the crown roller are constructed such that these rollers are simultaneously rotated in contact with the running web paper in its entire width. An outside diameter of each of the rollers gradually changed in left-right symmetry in an axial direction gives different tensions and sending directions to the center and both sides of the web paper running in contact with these rollers. Thus, the paper wrinkle preventing device prevents the web paper from being wrinkled by spreading the web paper in its width direction.

For example, a paper wrinkle preventing device having an expander roller shown in Japanese Published (Kokoku) Utility Model No. 62-32204 (prior art 2) and Japanese Laid-Open (Kokai) Patent No. 6-297605 (prior art 3) instead of the above reverse crown roller and the above crown roller is also known. This expander roller gives a sending-out direction directed to widen the width of the web paper in its entire width to the web paper running in contact with this expander roller by a peculiar movement or shape of a circumferential face of this expander roller in left-right symmetry with a longitudinal central position of this roller as a center. Thus, this paper wrinkle preventing device prevents the web paper from being wrinkled by spreading the web paper in its width direction.

The above conventional techniques have several problems to be solved. The angular deformation caused in the web paper offset-printed between the blanket cylinder of the above offset printing portion and the drag roller downstream from this blanket cylinder is left as flat wrinkles as it is when this web paper comes in contact with the drag roller as it is. Therefore, the quality of a product as a printed matter is reduced so that this product cannot be used as an article of commerce in a certain case.

Therefore, the applicant of this application made a trial for removing the paper wrinkles by a paper wrinkle removing device using the reverse crown roller, the crown roller and the expander roller disclosed in the above prior arts 1, 2 and 3.

However, when an entire face of the web paper having the above angular deformation simultaneously comes in contact with the rollers as entire face wrinkle removing rollers, the angular deformation becomes flat wrinkles. Further, no action for widening the web paper in the width direction by the wrinkle removing rollers reaches portions of the above flat wrinkles since strength of the web paper is reduced by wet water and the web paper is further enlarged in the width direction. Accordingly, no flat wrinkles can be removed from the web paper.

SUMMARY OF THE INVENTION

To solve the above problems, this invention proposes a paper wrinkle preventing device in a rotary printing press which has an offset printing portion for printing web paper coming in contact with surfaces of two blankets having side edges adjacent to each other at an approximately axial center of a blanket cylinder, and also has a drag roller for pulling the printed web paper downstream from the offset printing portion, the paper wrinkle preventing device being characterized in that a contact roller is arranged between the offset printing portion and the drag roller such that a circumferential face of the contact roller can rotatably come in contact with the running web paper, and an equal diameter portion is formed by a roller portion coming in contact with a portion of the running web paper coming in contact with an adjacent portion of each of the two blankets and a portion near this adjacent portion, and the contact roller is formed in a taper shape having a diameter reduced as each of both side portions of the equal diameter portion approaches an end portion of the contact roller.

This invention also proposes a paper wrinkle preventing device in a rotary printing press which has an offset printing portion for printing web paper coming in contact with surfaces of two blankets having side edges adjacent to each other at an approximately axial center of a blanket cylinder, and also has a drag roller for pulling the printed web paper downstream from the offset printing portion, the paper wrinkle preventing device being characterized in that a contact roller is arranged between the offset printing portion and the drag roller such that a circumferential face of the contact roller can rotatably come in contact with the running web paper, and an equal diameter portion is formed by a roller portion coming in contact with a portion of the running web paper coming in contact with an adjacent portion of each of the two blankets and a portion near this adjacent portion, and the contact roller is formed in a taper shape having a diameter reduced as each of both side portions of the equal diameter portion approaches an end portion of the contact roller; and angular deformation caused in the portion of the offset-printed web paper coming in contact with the adjacent portion of each of the two blankets and the portion near this adjacent portion is dispersed as a small swelling by making the equal diameter portion of the contact roller come in contact with the web paper with a contact pressure set so as to uniform the angular deformation.

In the above paper wrinkle preventing devices, the contact roller is movably arranged such that the contact roller can be separated from the web paper and can approach the web paper to adjust a contact state with the web paper.

Further, in the above paper wrinkle preventing devices, the contact roller is arranged downstream from a most downstream offset printing portion so as to come in contact with the web paper sequentially continuously printed in plural offset printing portions.

DESCRIPTION OF THE PREFERRED EMBODIMENTS

Figure 1:
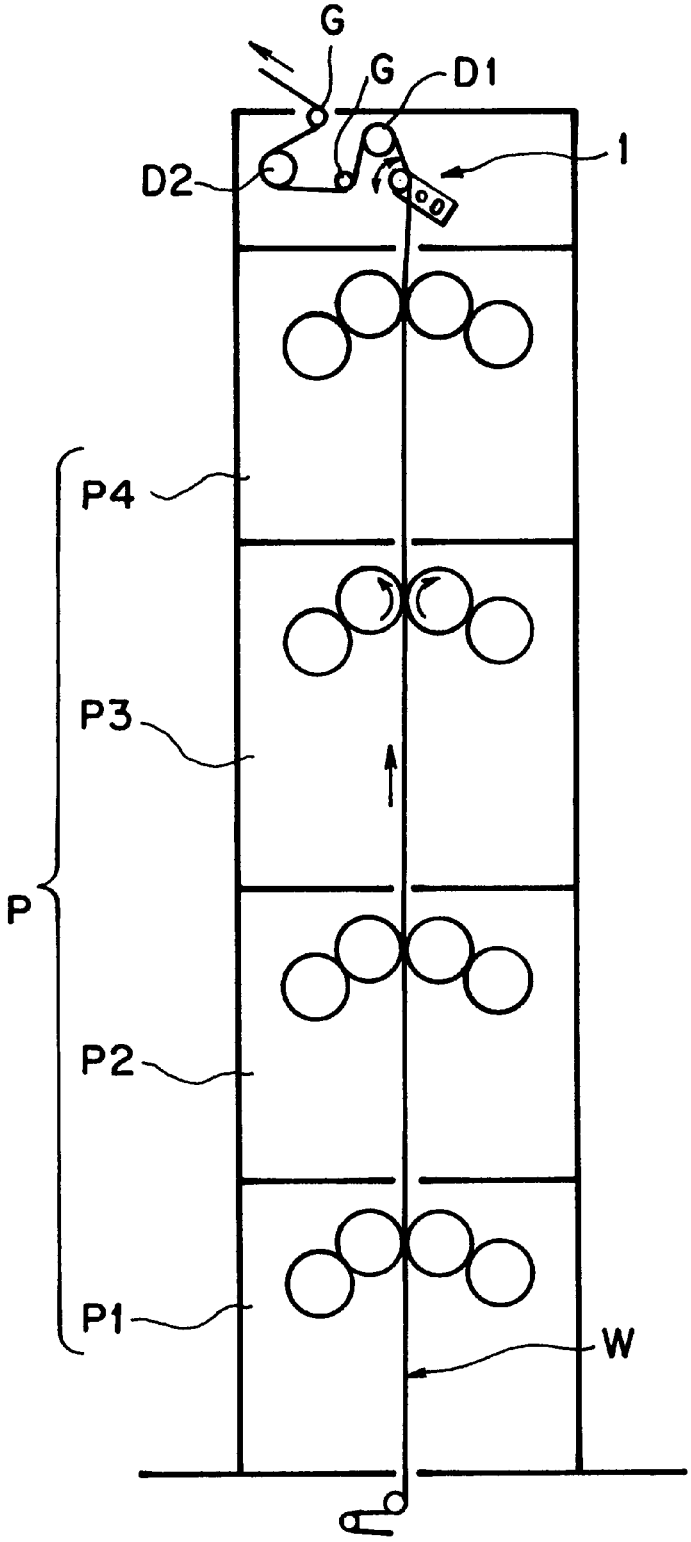
FIG. 1 is a sectional explanatory view of a printing press to which a paper wrinkle preventing device in an embodiment mode of this invention is applied.
Figure 2:
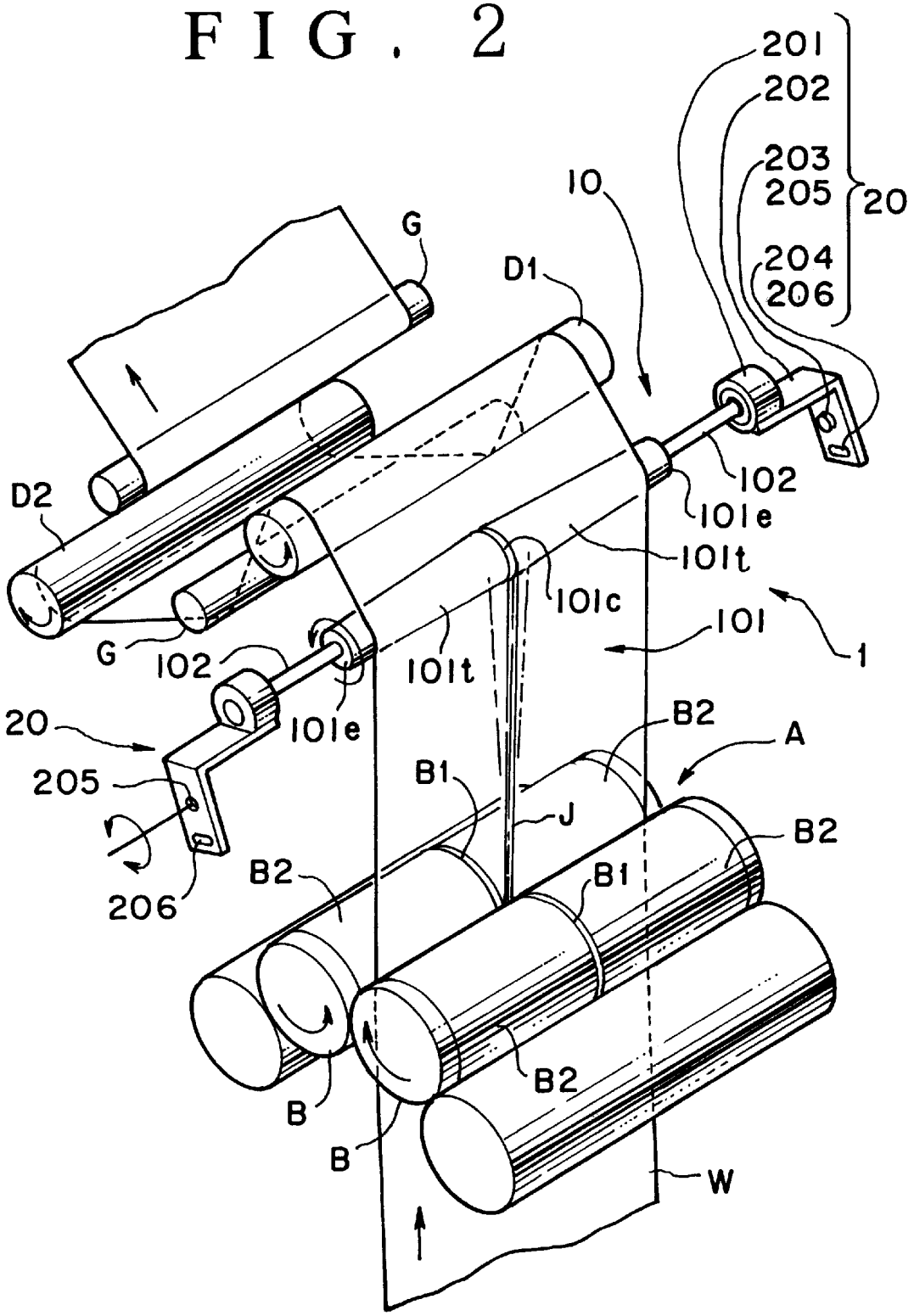
FIG. 2 is a perspective view of the paper wrinkle preventing device having an advancing-retreating movement adjusting means in the first embodiment mode assembled into the printing press.
Figure 3:
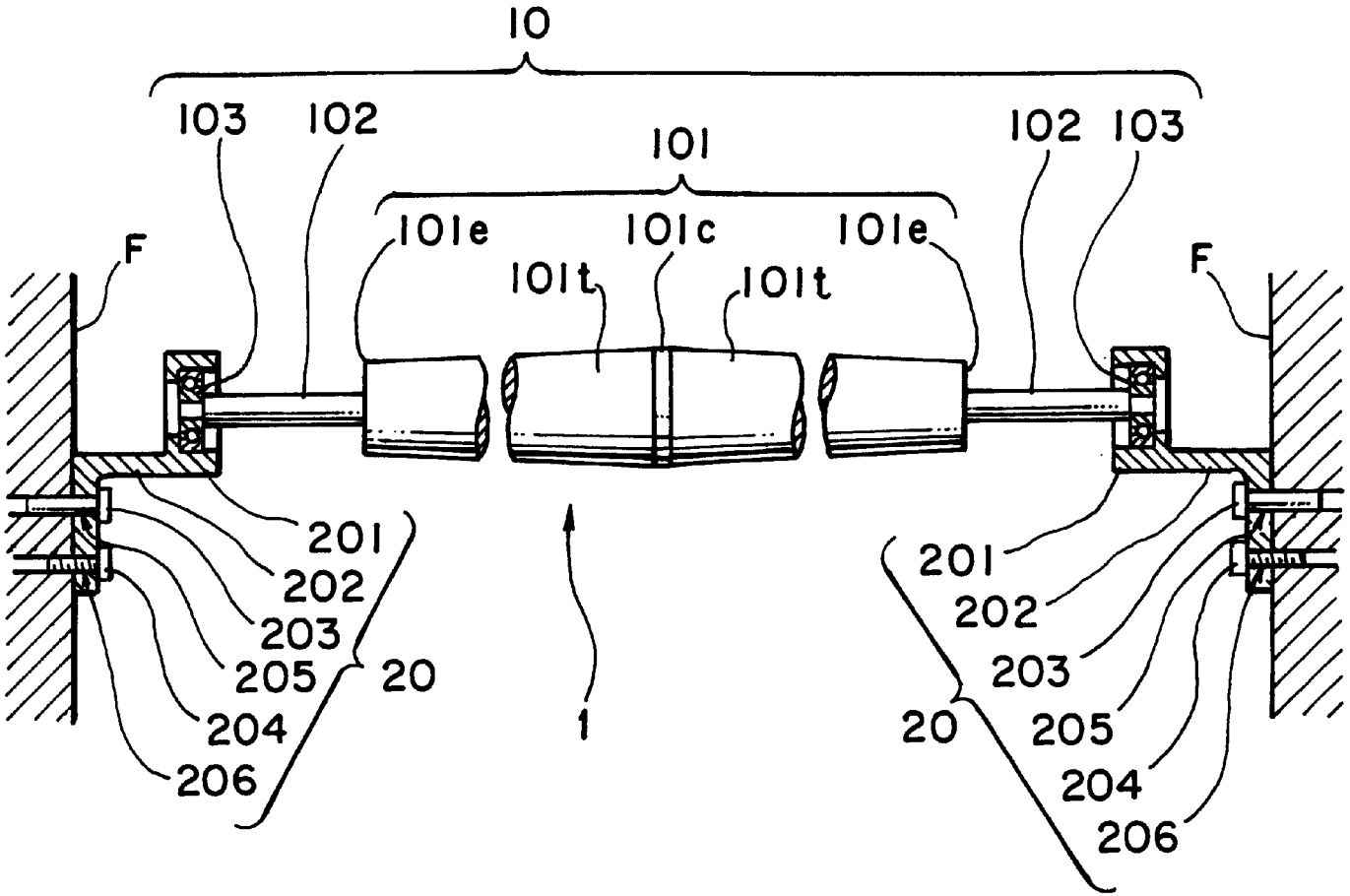
FIG. 3 is a cross-sectional view of the paper wrinkle preventing device having the advancing-retreating movement adjusting means in the first embodiment mode.
Figure 4:
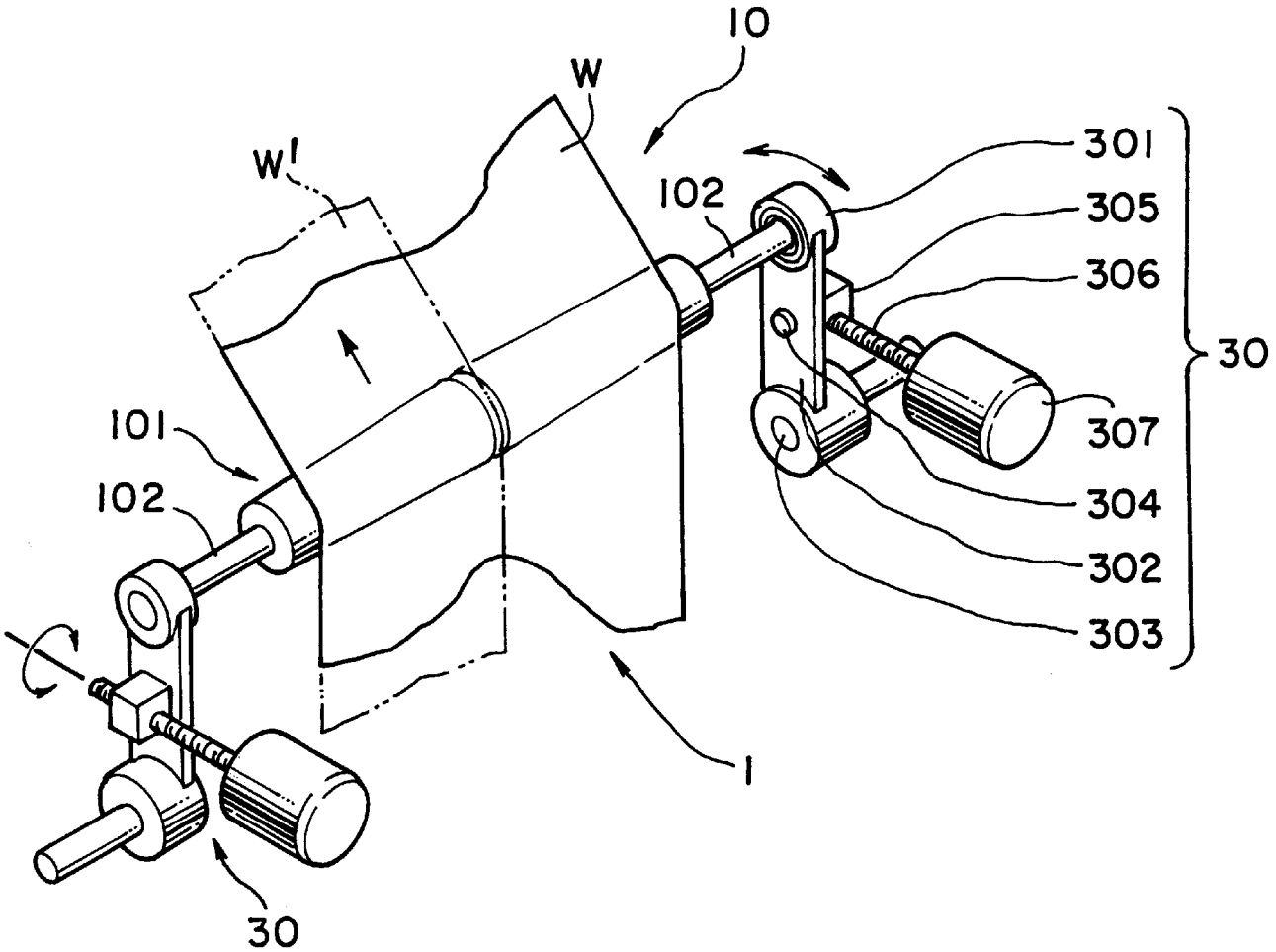
FIG. 4 is a perspective view of a paper wrinkle preventing device having an advancing-retreating movement adjusting means in a second embodiment mode assembled into the printing press.
Figure 5:
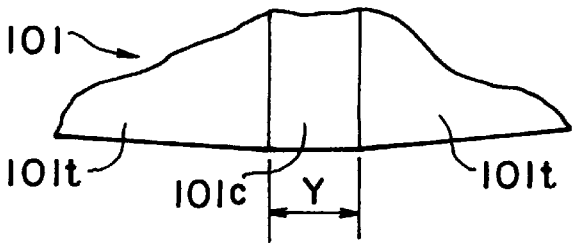
FIG. 5 is a partially enlarged view of an equal diameter portion of a contact roller in the embodiment modes of this invention.

A paper wrinkle preventing device of this invention will next be described with reference to FIGS. 1 to 5 showing. one embodiment mode of this paper wrinkle preventing device. FIG. 1 is a sectional explanatory view of a printing press to which the paper wrinkle preventing device of this invention is applied. FIG. 2 is a perspective view of the paper wrinkle preventing device having an advancing-retreating movement adjusting means in the first embodiment mode assembled into the printing press. FIG. 3 is a cross-sectional view of the paper wrinkle preventing device having the advancing-retreating movement adjusting means in the first embodiment mode. FIG. 4 is a perspective view of a paper wrinkle preventing device having an advancing-retreating movement adjusting means in a second embodiment mode assembled into the printing press. FIG. 5 is a partially enlarged view of a portion near an equal diameter portion of a contact roller in the embodiment modes of this invention.

The paper wrinkle preventing device 1 showing one embodiment mode of this invention is used in an offset rotary press for a newspaper, etc. using web paper easily extended and contracted by absorbed humidity, drying, etc. For example, the paper wrinkle preventing device 1 is arranged downstream from a tower type printing press P as shown in FIG. 1. Reference numerals D1, D2 and G respectively designate a drag roller, a downstream drag roller and a guide roller.

The tower type printing press P is constructed by four printing units composed of a first printing unit P1, a second printing unit P2, a third printing unit P3 and a fourth printing unit P4. The tower type printing press P can efficiently perform a multiple color printing operation so that plural printing units are normally stacked and used. As shown in FIG. 1, web paper W is introduced from an upstream side of the first printing unit P1 of the tower type printing press P to perform the multiple color printing operation. The web paper W reaches the drag roller D1 sequentially through the downstream second printing unit P2, the third printing unit P3 and the fourth printing unit P4 in a state in which suitable tension is given to the web paper W.

Figure 6:
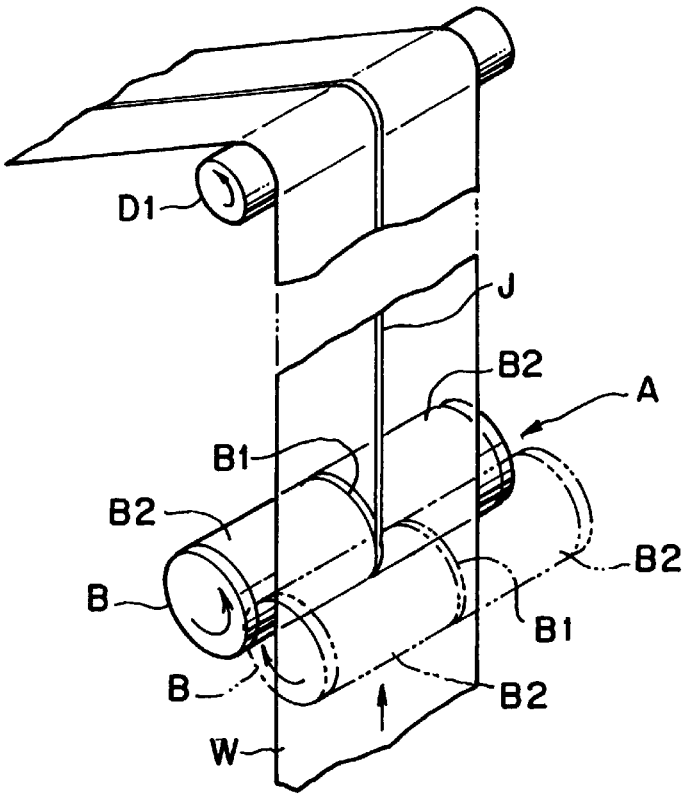
FIG. 6 is a perspective view of an angular deforming portion of web paper in a conventional printing press.
Figure 7:
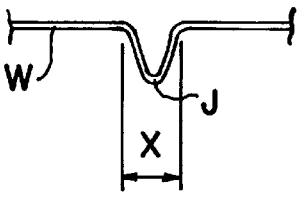
FIG. 7 is a sectional enlarged view of the angular deforming portion of the web paper shown in FIG. 6.

The printed web paper W is sent further downstream. When the web paper W passes through the fourth printing unit P4, tension of the web paper in its running direction in a portion corresponding to an adjacent portion B1 of each of side edges of two blankets B2, B2 (see FIG. 2) becomes greater than that in the other portions since an enlarging amount of the web paper caused by wet water is small. Therefore, very clear narrow angular deformation J having a width X (see FIGS. 6 and 7 showing a conventional example) is caused between a blanket cylinder B in this corresponding portion and the downstream drag roller D1. When this angular deformation J comes in contact with the downstream drag roller D1, the angular deformation J is left as flat wrinkles as it is. The width X in the embodiment mode of this invention normally ranges from 1 to 5 millimeters in many cases.

In this invention, as shown in FIG. 1, the paper wrinkle preventing device 1 is arranged between the fourth printing unit P4 and the drag roller D1 to prevent the above angular deformation J from being formed as flat wrinkles.

The paper wrinkle preventing device in the first embodiment mode based on FIGS. 2 and 3 and a paper wrinkle preventing device in a second embodiment mode based on FIG. 4 will next be explained.

In the paper wrinkle preventing device in the first embodiment mode shown in FIGS. 2 and 3, a contact roller 10 is constructed by a taper roller 101 having an intermediate height and an axial length according to a width of the web paper W, and shafts 102, 102. The taper roller 101 is arranged such that a circumferential face of the taper roller 101 can rotatably come in contact with the running web paper W. An equal diameter portion 101*c* is formed by a roller portion coming in contact with a portion of the web paper in which the running web paper W comes in contact with the adjacent portion B1 of each of the two blankets B2, B2 and a portion near this adjacent portion B1. Both side portions of the equal diameter portion 101*c* are formed by taper portions 101*t*, 101*t* formed in a taper shape and having diameters reduced as both the side portions of the equal diameter portion 101*c* respectively approach end portions 101*e*, 101*e*.

In the embodiment mode shown in FIGS. 2 and 3, the contact roller 10 comes in contact with the web paper W pulled and traveled by the drag roller D1 arranged downstream from an offset printing portion A with a contact pressure set such that the angular deformation J is uniformed by contact with the equal diameter portion 101*c*. Thus, the angular deformation J of the web paper W is dispersed by this contact with the equal diameter portion 101*c* as small swellings on both sides of the equal diameter portion 101*c*. This action is taken because both side portions of the equal diameter portion 101*c* are the taper portions 101*t*, 101*t* so that the contact pressure with the web paper W is gradually reduced from the equal diameter portion 101*c* to the end portions. In the web paper W having the angular deformation J dispersed as small swellings, the small swelling portions reach the drag roller D1 while the small swellings are dispersed toward both side edges of the web paper W during running of the web paper. Accordingly, no paper wrinkles are caused.

Further, the contact roller 10 has circumferential faces constructed by the taper portions 101*t*, 101*t* continuously connected to the equal diameter portion 101*c* and having diameters reduced toward the end portions 101*e*, 101*e*. Accordingly, no large difference in contact pressure applied to the web paper W is caused with both side edges of the equal diameter portion 101*c* as boundaries. Therefore, no permanent deformation is caused by the contact pressure only in a portion of the web paper W coming in contact with the equal diameter portion 101*c*. Further, new wrinkles or deformation of the web paper W causing wrinkles is not caused by the large difference in contact pressure with both the side edges of the equal diameter portion 101*c* as starting ends.

When the equal diameter portion 101*c* comes in contact with the angular deformation J, there is almost no difference in action for dispersing the angular deformation J as small swellings on both sides of the equal diameter portion 101*c* even when the equal diameter portion 101*c* comes in contact with the angular deformation J from a deformation projecting side and a deformation recessing side.

First advancing-retreating movement adjusting means 20, 20 are constructed by supporting members 202, 202 having housing portions 201, 201 for attaching bearings 103, 103, and pivots 203, 203 and bolts 204, 204 for attaching the supporting members 202, 202 onto attaching faces of frames F, F so as to angularly displace the supporting members 202, 202. The supporting members 202, 202 are respectively constructed by holes 205, 205 inserting the pivots 203, 203 thereinto, elongated holes 206, 206 inserting the bolts 204, 204 for positioning thereinto and having suitable lengths, and the housing portions 201, 201 so as to make the taper roller 101 suitably come in contact with the web paper W.

The supporting members 202, 202 are angularly displaced by the first advancing-retreating movement adjusting means 20, 20 with the pivots 203, 203 attached to the left-hand and right-hand frames F, F as fulcrums. Thus, the equal diameter portion 101*c* of the taper roller 101 can be advanced and retreated with respect to the web paper W such that the equal diameter portion 101*c* can come in contact with the web paper W with a contact pressure set so as to uniform the angular deformation J of the web paper W. When the taper roller 101 is suitably positioned, the supporting members 202, 202 are fixed by fastening the bolts 204, 204 inserted into the elongated holes 206, 206 and attached to the frames F, F.

FIG. 4 shows a second embodiment mode of this invention as another embodiment mode of the advancing-retreating movement adjusting means. Second advancing-retreating movement adjusting means 30, 30 are constructed by supporting members 302, 302, pivots 303, 303, female screw members 305, 305, screw shafts 306, 306, and driving means 307, 307. The supporting members 302, 302 respectively have housing portions 301, 301 (corresponding to reference numeral 201 in FIG. 3) for supporting bearings 103, 103 (see FIG. 3) arranged in end portions of shafts 102, 102 of the taper roller 101. The pivots 303, 303 respectively attach the supporting members 302, 302 to the frames F, F. The female screw members 305, 305 are respectively integrated with pins 304, 304 inserted into holes of the supporting members 302, 302 and rotatably attached to the supporting members 302, 302. The screw shafts 306, 306 are rotatably screwed into the female screw members 305, 305. The driving means 307, 307 are respectively connected to the other ends of the screw shafts 306, 306.

For example, if the driving means 307 is used by fixing a pulse motor to the frame F, etc., angular displacing amounts of the supporting members 302, 302 can be very easily adjusted by an unillustrated controller. The driving means 307 may be constructed by using an unillustrated direct operated actuator such as an ultrasonic linear motor, a piezoelectric actuator, etc. The female screw member 305 may be constructed by using an unillustrated other connecting member.

In accordance with the second advancing-retreating movement adjusting means 30, 30, the screw shafts 306, 306 respectively connected to the driving means 307, 307 are suitably rotated normally or reversely by the driving means 307, 307 (e.g., pulse motors) by receiving suitable commands from the controller. The female screw members 305, 305 engaged with the screw shafts 306, 306 are respectively moved forward and backward on the screw shafts 306, 306. Thus, the supporting members 302, 302 are respectively suitably displaced angularly with the pivots 303, 303 as fulcrums through the pins 304, 304 integrated with the female screw members 305, 305. Accordingly, the taper roller 101 constituting the contact roller 10 supported by the housing portions 301, 301 arranged in end portions of the supporting members 302, 302 through the bearings 103, 103 (see FIG. 3) can be advanced and retreated with respect to the web paper W such that the taper roller 101 can come in contact with the web paper W with a contact pressure set so as to uniform the angular deformation J of the web paper W. Operations of the left-hand and right-hand pulse motors 307, 307 can be also separately controlled.

If the bearings 103, 103 in FIG. 3 are used as automatic aligning type bearings, operations of the advancing-retreating movement adjusting means 20, 20 and 30, 30 arranged on the left-hand and right-hand sides in FIGS. 2 and 4 can be independently adjusted easily. There are many cases in which web paper W' having a width narrower than that of the web paper W of an entire width often used in a rotary press, e.g., a half of the width of the web paper W as shown in FIG. 4 is used. However, no problem such as a paper flow, etc. is caused by the advancing-retreating movement adjusting means able to be independently adjusted on the left-hand and right-hand sides even when the web paper has a narrow width and is dislocated from a central portion of the equal diameter portion 101*c* of the taper roller 101 and asymmetrically comes in contact with the equal diameter portion 101*c*.

In this invention, the angular deformation J to be removed from the web paper without causing any paper wrinkles is caused in the web paper W approximately along a central position of each of the blanket cylinders B, B. As shown in FIGS. 6 and 7, when the web paper W passes through the pair of blanket cylinders B, B, of the offset printing portion A and is pulled by the downstream drag roller D1, the angular deformation J is normally caused as a very clear angular shape in a portion of the web paper W coming in contact with a portion near an adjacent portion B1 of each of side edges of the two blankets B2, B2 in a range of the width X (see FIG. 7) from 1 to 5 millimeters between the blanket cylinders B, B, of the offset printing portion A and the drag roller D1 downstream from these blanket cylinders B, B.

Therefore, in the contact roller 10 shown in FIG. 2, the inventor of this application made a test for variously setting an axial width Y (see FIG. 5) of the equal diameter portion 101*c* coming in contact with a portion of the running web paper W coming in contact with a portion near the adjacent portion B1 of each of the two blankets B2, B2. As a result, when the width Y is set in a range from 2 to 5 millimeters in accordance with the width X of an angular shape caused in the web paper W, it is confirmed that the angular deformation J can be dissolved most effectively.

In accordance with this invention, the equal diameter portion 101*c* of the contact roller 10 comes in contact with the angular deformation J caused in a portion of the offset-printed web paper W coming in contact with the adjacent portion B1 of each of side edges of the two blankets B2, B2 of the blanket cylinder B with a contact pressure set so as to uniform this angular deformation J. Accordingly, the contact pressure with the web paper W is reduced in comparison with the equal diameter portion 101*c* by the taper portion 101*t* having a diameter reduced as each of both sides of the equal diameter portion 101*c* approaches each of the end portions 101*e*, 101*e*. Thus, the angular deformation J is dispersed as small swellings by the contact of the equal diameter portion 101*c* of the contact roller 10 on both sides of the equal diameter portion 101*c*. No wrinkles are caused in the web paper W having the angular deformation J dispersed as small swellings since the small swellings are dispersed toward both side edges of the web paper W during running of the web paper W and reach the drag roller D1.

Further, the contact roller 10 has a circumferential face constructed by the taper portion 101*t* continuously connected to the equal diameter portion 101*c* and having a diameter reduced toward the end portion 101*e*. Accordingly, no large difference in contact pressure applied to the web paper W is caused with both side edges of the equal diameter portion 101*c* as boundaries. No permanent deformation is also caused by the contact pressure only in a portion of the web paper coming in contact with the equal diameter portion 101*c*. Further, new wrinkles or deformation causing wrinkles is not caused by the large difference in contact pressure with both side edges of the equal diameter portion 101*c* as starting ends. When the equal diameter portion 101*c* comes in contact with the angular deformation J, there is almost no difference in action for dispersing the angular deformation J as small swellings on both sides of the equal diameter portion 101*c* even when the equal diameter portion 101*c* comes in contact with the angular deformation J from a deformation projecting side and a deformation recessing side.

In the paper wrinkle preventing device of this invention, the angular deformation can be dispersed as small swellings in both side portions of the equal diameter portion by making the equal diameter portion of the contact roller come in contact with the web paper with a contact pressure set so as to uniform the angular deformation of the offset-printed web paper caused in its contact portion coming in contact with the adjacent portion of each of side edges of the two blankets. Therefore, no wrinkles are caused in the running web paper since the small swellings are dispersed toward both side edges of the web paper during running of the web paper and reach the drag roller.

Further, the contact roller has a circumferential face constructed by the taper portion continuously connected to the equal diameter portion and having a diameter reduced toward the end portion. Accordingly, no large difference in contact pressure applied to the web paper is caused with both side edges of the equal diameter portion as boundaries. No permanent deformation is also caused by the contact pressure only in a portion of the web paper coming in contact with the equal diameter portion. Further, new wrinkles or deformation causing wrinkles is not caused by the large difference in contact pressure with both side edges of the equal diameter portion as starting ends. Therefore, the angular deformation caused in the web paper along an approximately central position of the blanket cylinder can be dissolved on a downstream side of the offset printing portion.

Since the angular deformation caused in the web paper is dissolved, no printed matter untreated as an article of commerce is formed and printing quality can be improved and damaged paper can be reduced, and paper resources and cost, etc. can be saved.

What is claimed is:

1. A paper wrinkle preventing device in a rotary printing press which has an offset printing portion for printing web paper coming in contact with surfaces of two blankets having side edges adjacent to each other at an approximately axial center of a blanket cylinder, and also has a drag roller for pulling the printed web paper downstream from the offset printing portion, the paper wrinkle preventing device being characterized in that a contact roller is arranged between the offset printing portion and the drag roller such that a circumferential face of the contact roller can rotatably come in contact with the running web paper, and an equal diameter portion is formed by a roller portion coming in contact with a portion of the running web paper coming in contact with an adjacent portion of each of the two blankets and a portion near this adjacent portion, and the contact roller is formed in a taper shape having a diameter reduced as each of both side portions of the equal diameter portion approaches an end portion of the contact roller.

2. The paper wrinkle preventing device as defined in claim 1, wherein the contact roller is movably arranged such that the contact roller can be separated from the web paper and can approach the web paper to adjust a contact state with the web paper.

3. The paper wrinkle preventing device as defined in claim 1, wherein the contact roller is arranged downstream from a most downstream offset printing portion so as to come in contact with the web paper sequentially continuously printed in plural offset printing portions.

4. The paper wrinkle preventing device as defined in claim 2, wherein the contact roller is arranged downstream from a most downstream offset printing portion so as to come in contact with the web paper sequentially continuously printed in plural offset printing portions.

5. A paper wrinkle preventing device in a rotary printing press which has an offset printing portion for printing web paper coming in contact with surfaces of two blankets having side edges adjacent to each other at an approximately axial center of a blanket cylinder, and also has a drag roller for pulling the printed web paper downstream from the offset printing portion, the paper wrinkle preventing device being characterized in that a contact roller is arranged between the offset printing portion and the drag roller such that a circumferential face of the contact roller can rotatably come in contact with the running web paper, and an equal diameter portion is formed by a roller portion coming in contact with a portion of the running web paper coming in contact with an adjacent portion of each of the two blankets and a portion near this adjacent portion, and the contact roller is formed in a taper shape having a diameter reduced as each of both side portions of the equal diameter portion approaches an end portion of the contact roller; and angular deformation caused in the portion of the offset-printed web paper coming in contact with the adjacent portion of each of the two blankets and the portion near this adjacent portion is dispersed as a small swelling by making the equal diameter portion of the contact roller come in contact with the web paper with a contact pressure set so as to uniform the angular deformation.

6. The paper wrinkle preventing device as defined in claim 5, wherein the contact roller is movably arranged such that the contact roller can be separated from the web paper and can approach the web paper to adjust a contact state with the web paper.

7. The paper wrinkle preventing device as defined in claim 5, wherein the contact roller is arranged downstream from a most downstream offset printing portion so as to come in contact with the web paper sequentially continuously printed in plural offset printing portions.

* * * * *